US011423850B2

(12) United States Patent
Hsieh et al.

(10) Patent No.: US 11,423,850 B2
(45) Date of Patent: Aug. 23, 2022

(54) DISPLAYS WITH DIMMING ZONES THAT CHANGE

(71) Applicant: Hewlett-Packard Development Company, L.P., Spring, TX (US)

(72) Inventors: Hsing-Hung Hsieh, Taipei (TW); Kuan-Ting Wu, Taipei (TW); Super Liao, Taipei (TW)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/042,157

(22) PCT Filed: Nov. 27, 2018

(86) PCT No.: PCT/US2018/062508

§ 371 (c)(1),
(2) Date: Sep. 27, 2020

(87) PCT Pub. No.: WO2020/112085

PCT Pub. Date: Jun. 4, 2020

(65) Prior Publication Data

US 2021/0295786 A1 Sep. 23, 2021

(51) Int. Cl.

| | |
|---|---|
| ***G09G 3/34*** | (2006.01) |
| ***G09G 3/36*** | (2006.01) |
| ***G09G 5/10*** | (2006.01) |

(52) U.S. Cl.

CPC ..... *G09G 3/342* (2013.01); *G09G 3/3648* (2013.01); *G09G 5/10* (2013.01); *G09G 2320/0686* (2013.01)

(58) Field of Classification Search

CPC ..... G09G 3/342; G09G 3/3648; G09G 5/10; G09G 2320/0686; G09G 3/007;

(Continued)

(56) References Cited

U.S. PATENT DOCUMENTS

| | | | | |
|---|---|---|---|---|
| 6,747,671 | B1 | 6/2004 | Saito | |
| 8,581,941 | B2 * | 11/2013 | Onishi | G09G 3/3426 345/204 |

(Continued)

FOREIGN PATENT DOCUMENTS

| | | |
|---|---|---|
| CN | 102314844 | 1/2012 |
| CN | 102479496 | 5/2012 |

(Continued)

*Primary Examiner* — Rodney Amadiz

(74) *Attorney, Agent, or Firm* — Tong Rea Bentley & Kim LLC

(57) ABSTRACT

In example implementations, a display is provided. The display includes a plurality of light emitting diodes (LEDs), a thin film transistor (TFT) substrate, a liquid crystal layer, a color filter (CF) substrate, and a controller. The TFT substrate is formed over the LEDs to control emission of light from the plurality of LEDs. The liquid crystal layer is formed over the TFT substrate. The CF substrate is formed over the liquid crystal layer to control a color of the light emitted from the plurality of LEDs. The controller is communicatively coupled to the plurality of LEDs to group subsets of LEDs of the plurality of LEDs into a plurality of local dimming zones, wherein the subsets of LEDs in each one of the plurality of local dimming zones changes over time.

13 Claims, 5 Drawing Sheets

(58) Field of Classification Search
CPC ..... G09G 2320/043; G09G 2320/046; G09G 2320/048; G09G 2320/0646; G09G 2320/0626; G09G 2360/145; G09G 3/3426
See application file for complete search history.

(56) References Cited

U.S. PATENT DOCUMENTS

| | | | | |
|---|---|---|---|---|
| 2007/0201226 | A1* | 8/2007 | Nishigaki | G02B 6/0068 362/231 |
| 2008/0252590 | A1 | 10/2008 | Hiroshi | |
| 2009/0135128 | A1 | 5/2009 | Jeon et al. | |
| 2010/0060671 | A1 | 3/2010 | Park et al. | |
| 2010/0245397 | A1 | 9/2010 | Choe et al. | |
| 2010/0309109 | A1* | 12/2010 | Won | G09G 3/3426 345/102 |
| 2011/0050668 | A1* | 3/2011 | Park | G09G 3/3426 345/211 |
| 2011/0316902 | A1* | 12/2011 | Onishi | G09G 3/3611 345/102 |
| 2012/0127210 | A1 | 5/2012 | Huang et al. | |
| 2015/0130850 | A1* | 5/2015 | Wyatt | G09G 3/3611 345/690 |
| 2016/0306097 | A1* | 10/2016 | Fujita | A63F 7/022 |
| 2017/0061899 | A1 | 3/2017 | Nagashima | |
| 2017/0110068 | A1 | 4/2017 | Lee et al. | |

FOREIGN PATENT DOCUMENTS

| | | |
|---|---|---|
| CN | 105788539 | 7/2016 |
| CN | 105976770 | 9/2016 |
| CN | 106101594 | 11/2016 |
| EP | 2472500 | 7/2012 |
| EP | 3016094 | 5/2016 |
| JP | 2018055079 | 4/2018 |
| KR | 20020057023 | 7/2002 |
| KR | 20040031858 | 4/2004 |

* cited by examiner

DISPLAYS WITH DIMMING ZONES THAT CHANGE

BACKGROUND

Displays can be used to produce a visible image. Displays have evolved over time from cathode ray tube (CRT) based displays to light emitting diode (LED) based displays. The LED based displays can provide a smaller and lighter display that is more energy efficient than CRT based displays.

DETAILED DESCRIPTION

Examples described herein provide displays with rolling dimming zones. As discussed above, displays can be manufactured with LEDs. Some LED based displays are being manufactured with high dynamic range (HDR) capability. The LEDs may be grouped into fixed dimming zones. The fixed dimming zones may cause visible edges to be formed over time.

For example, the LEDs in each group may decay over time at different rates. Different zones may display different images. For example, a zone on the display may always display a logo. As a result, the LEDs in a zone with the logo may decay at a much faster rate than the LEDs in other zones. Eventually, a visible edge between dimming zones may be seen.

Examples herein provide a display that has rolling dimming zones. For example, the grouping of the LEDs in each dimming zone may be changed over time. The zones may be moved gradually across the LEDs in the display. Said another way, the LEDs associated with each zone may be changed periodically. As a result, the rate of decay may be leveled for the LEDs over time. As a result, the edges between each dimming zone may be blurred and less visible over time.

Figure 1:
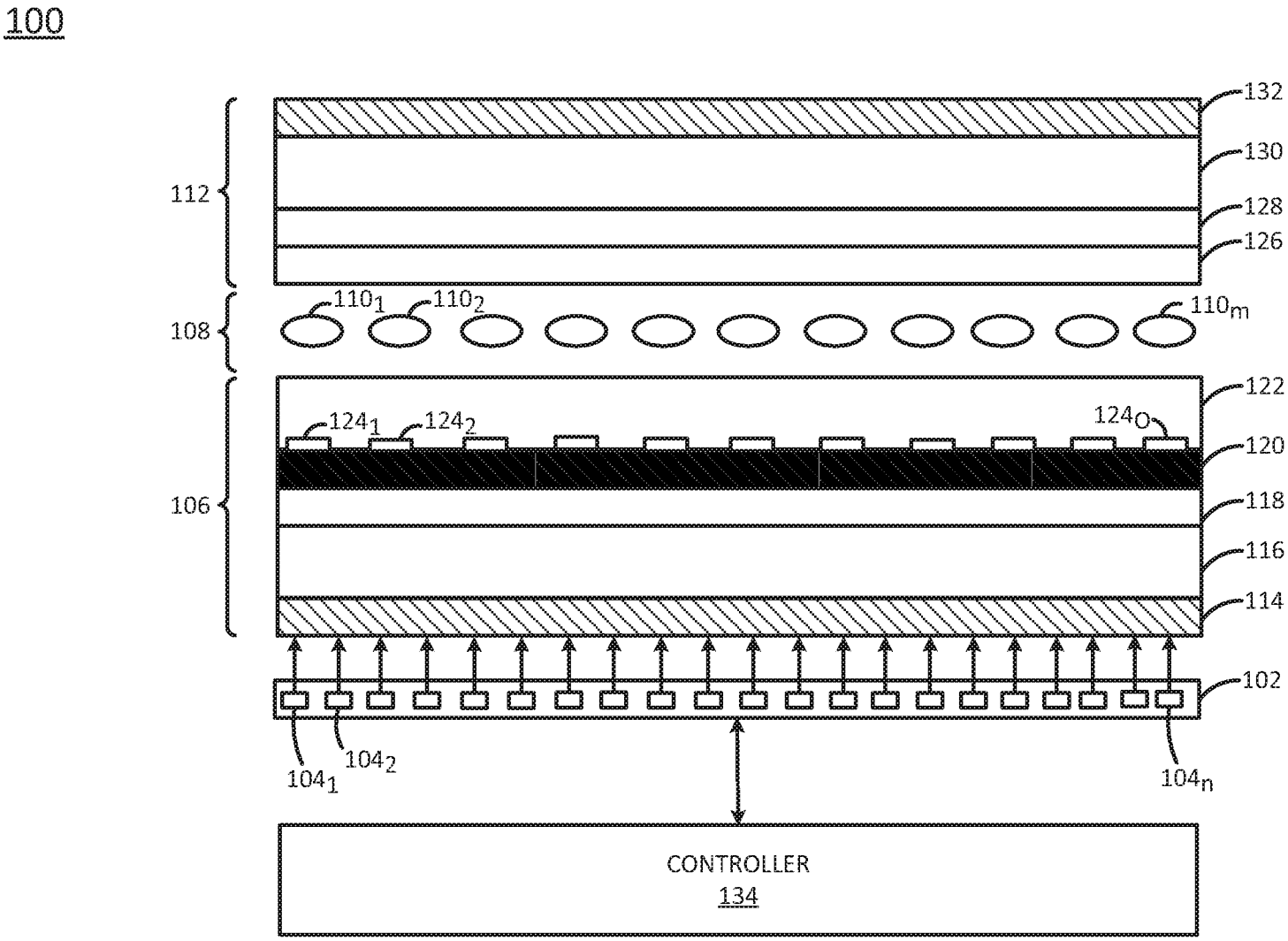
FIG. 1 is a block diagram of an example cross-sectional view of a display of the present disclosure.

FIG. 1 illustrates an example cross-sectional view of a display 100 with rolling dimming zones of the present disclosure. The display 100 may be a television, a computer monitor, and the like. The display 100 may be used to generate an image or motion video. The display 100 may provide color images using any color display technology (e.g., a red, green, blue (RGB) display).

In an example, the display 100 may include a backlight unit 102 with a plurality of light emitting diodes (LEDs) $\mathbf{104}_1$ to $\mathbf{104}_n$ (hereinafter also referred to individually as an LED 104 or collectively as LEDs 104). The LEDs 104 may provide light to display an image on the display 100. The LEDs 104 may emit enough light or luminance to illuminate the display 100. The size or brightness of the LEDs 104 may be a function of a size of the display 100. For example, a large display may use brighter LEDs 104. A smaller display may use either less LEDs 104 or dimmer LEDs.

The display 100 may include a thin film transistor (TFT) substrate 106 formed over the LEDs 104. The TFT substrate 106 may control emission of light from the LEDs 104. The TFT substrate 106 may include a glass substrate 116. A polarizer 114 may be located on a bottom side of the glass substrate 116 and a common electrode 118 may be located on a top side of the glass substrate 116. The TFT substrate 106 may include an insulator 120 on the common electrode 118 and an alignment layer 122 having a plurality of pixel electrodes $\mathbf{124}_1$ to $\mathbf{124}_o$ (hereinafter also referred to individually as a pixel electrode 124 or collectively as pixel electrodes 124).

The display 100 may include a liquid crystal layer 108 over the TFT substrate 106. The liquid crystal layer 108 may be located between the TFT substrate 106 and a color filter (CF) substrate 112.

The liquid crystal layer 108 may include a plurality of liquid crystals $\mathbf{110}_1$ to $\mathbf{110}_m$ (hereinafter also referred to individually as a liquid crystal 110 or collectively as liquid crystals 110). The orientation of the liquid crystals 110 may determine whether light emitted from the LEDs 104 passes through to a particular pixel of the display 100. In one example, the orientation of the liquid crystals 110 can be controlled by applying a voltage to a respective pixel electrode 124.

In one example, the alignment layer 122 may be a rubbed polyimide layer on the pixel electrodes 124. The pixel electrodes 124 may control respective liquid crystals 110 and remain aligned with the respective liquid crystals 110.

The CF substrate 112 may include a glass substrate 130 with color filters, and a polarizer 132 may be located on a top side of the glass substrate 130. The color filters in the glass substrate 130 may be red, green, and blue color filters that help to convert light emitted by the LEDs 104 into a desired color that is shown on the display 100. A common electrode 128 may be located on a bottom side of the glass substrate 130. An alignment layer 126 may be a rubbed polyimide layer formed on a bottom side of the common electrode 128.

In one example, the display 100 may also include a controller 134. The controller 134 may be a processor or an application specific integrated circuit (ASIC) to perform a particular function. The controller 134 may be communicatively coupled to the LEDs 104 and control operation of the LEDs 104. For example, the controller 134 may control which LEDs 104 turn on, when each LED 104 may turn on, a brightness level of each LED 104, and the like.

In one example, the LEDs 104 may be grouped into different dimming zones of LEDs. For example, for display 100 that may use high dynamic range (HDR), the groups of LEDs 104 may be controlled by the controller 134 to provide different levels of brightness or light output for each dimming zone of the display 100 based on the content that is shown in a respective dimming zone.

However, as noted above, different dimming zones of the display 100 may display different types of content. Thus, in dimming zones of the display 100 that show bright content continuously (e.g., a logo may be always shown in a particular zone), the LEDs 104 in that dimming zone may degrade sooner than LEDs 104 in other dimming zones. As a result, the brightness levels of each dimming zone may become non-uniform. In addition, the boundary of each dimming zone may become visible in the image that is shown on the display 100.

Figure 2:
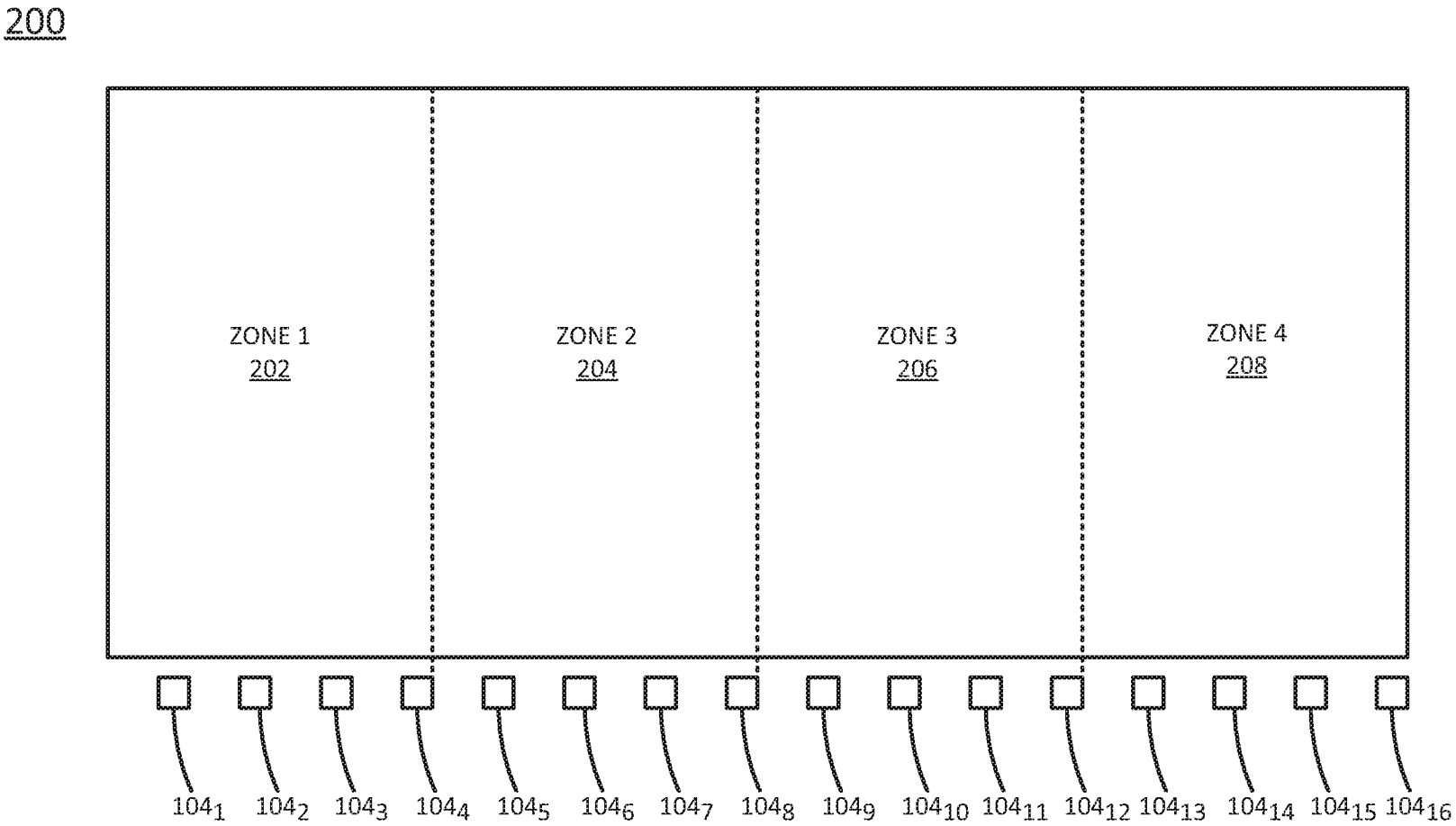
FIG. 2 is a block diagram of an example display with dimming zones of light emitting diodes (LEDs) of the present disclosure.
Figure 3:
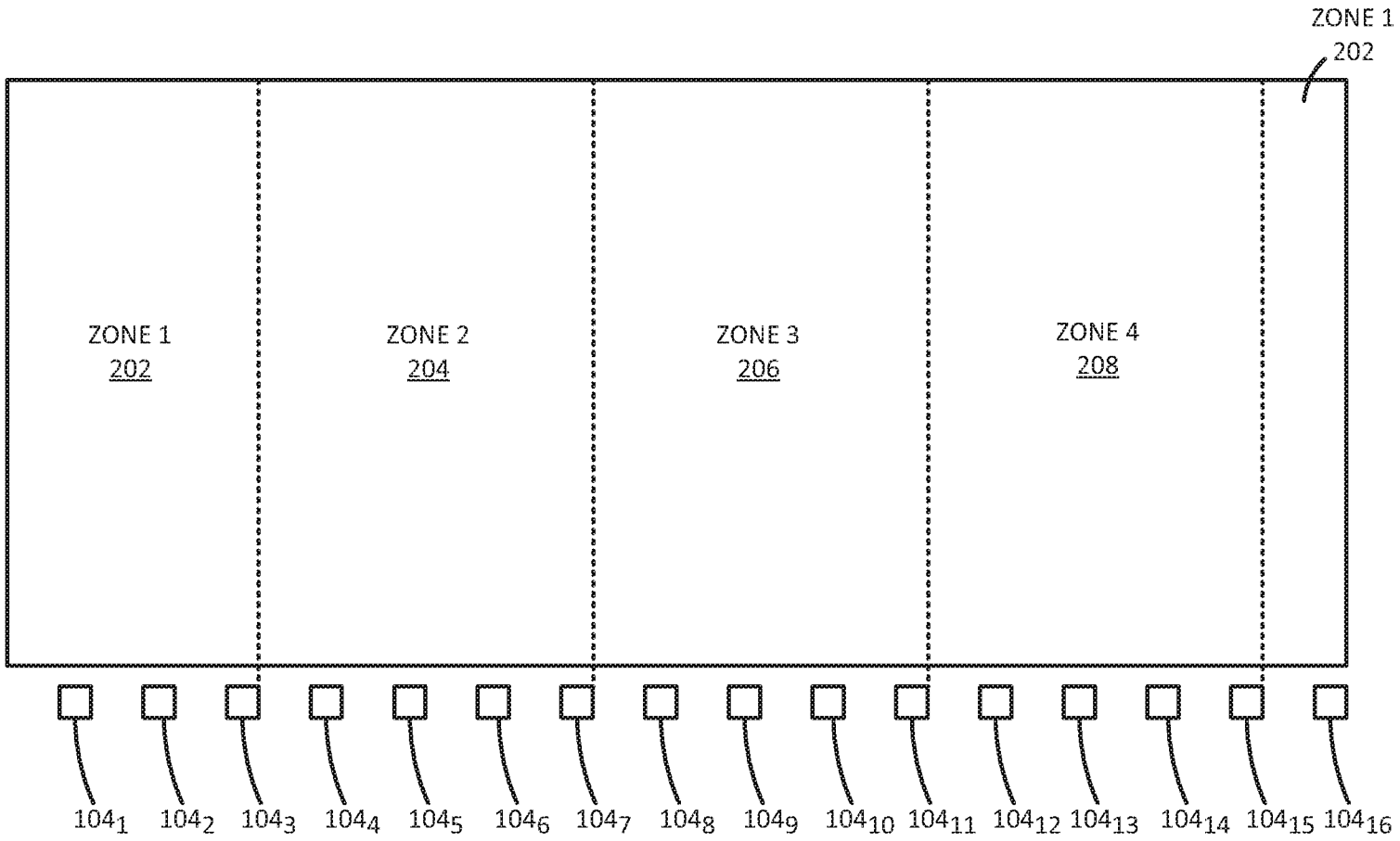
FIG. 3 is a block diagram of the example display that shows how the dimming zones of LEDs are rolled over time of the present disclosure.

The controller 134 of the present disclosure may roll the dimming zones of the display 100 to reduce the non-uniformity of LEDs 104 in each zone and blur the boundary between dimming zones to reduce the visibility of the dimming zone boundaries. FIG. 2 illustrates an example of dimming zones of a display 200 and FIG. 3 illustrates how the controller 134 may roll the dimming zones.

FIG. 2 illustrates an example of the display 200 having four dimming zones 202, 204, 206, and 208. Although four dimming zones are illustrated in FIG. 2, it should be noted that any number of dimming zones may be deployed in the display 200.

In one example, each dimming zone 202, 204, 206, and 208 may include at least one LED 104. In one example, the dimming zones 202, 204, 206, and 208 may include the same number of LEDs. In another example, the dimming zones 202, 204, 206, and 208 may include a different number of LEDs.

In the example illustrated in FIG. 2, each dimming zone 202, 204, 206, and 208 may include four LEDs 104. However, it should be noted that each dimming zone 202, 204, 206, and 208 may include any number of LEDs 104. For example, the dimming zone 202 may include LEDs $\mathbf{104}_1$-$\mathbf{104}_4$, the dimming zone 204 may include LEDs $\mathbf{104}_5$-$\mathbf{104}_8$, the dimming zone 206 may include LEDs $\mathbf{104}_8$-$\mathbf{104}_{12}$, and the dimming zone 208 may include LEDs $\mathbf{104}_{13}$-$\mathbf{104}_{18}$.

It should be noted that although the dimming zones 202, 204, 206, and 208 show the LEDS 104 in vertical zones, the dimming zones may be rolled as described herein in any geometric arrangement, shape, or pattern. For example, the dimming zones 202, 204, 206, and 208 may be arranged in horizontal rows of LEDs 104, a combination of horizontal rows and vertical rows, a checkerboard pattern of zones, and the like.

Thus, the controller 134 may control operation of each subset of LEDs 104 for each respective dimming zone 202, 204, 206, and 208. Each LED 104 within a subset of LEDs 104 of a particular dimming zone 202, 204, 206, and 208 may be controlled to have the same light output or brightness level. For example, the LEDs $\mathbf{104}_1$-$\mathbf{104}_4$ within the dimming zone 1 may be controlled to have the same light output or brightness level.

However, the brightness level of each subset of LEDs 104 of each dimming zone 202, 204, 206, and 208 may be controlled to be different. For example, the LEDs $\mathbf{104}_5$-$\mathbf{104}_8$ of the dimming zone 2 may be controlled to be brighter than the LEDs $\mathbf{104}_1$-$\mathbf{104}_4$ of the dimming zone 1. The controller 134 may control a brightness level of each subset of LEDs of each respective dimming zone 202, 204, 206, and 208 based on a content of an image that is shown in each dimming zone 202, 204, 206, and 208.

To prevent non-uniformity issues associated with uneven usage of the LEDs 104 in the different zones 202, 204, 206, and 208 described above, the controller 134 may roll the dimming zones 202, 204, 206, and 208. In one example, the controller 134 may roll the dimming zones 202, 204, 206, and 208 after a pre-defined time period. For example, the controller 134 may roll the dimming zones every 24 hours, every week, every month, and the like. The pre-defined time period may be static or may dynamically change over time. For example, the pre-defined time period may dynamically change over time based on a measured decay of the LEDs over time.

In one example, the pre-defined time period may be a function of a number of LEDs 104 in each dimming zone 202, 204, 206, and 208. For example, if a large number of LEDs 104 are used for each dimming zone 202, 204, 206, and 208 the boundaries may be more visible as the LEDs 104 decay. As a result, the pre-defined time period may be shorter (e.g., every week for dimming zones that are defined with 10 more LEDs). In contrast, if a small number of LEDs 104 are used for each dimming zone 202, 204, 206, and 208 the boundaries may be less visible as the LEDs 104 decay. As a result, the pre-defined time period may be longer (e.g., every three months for dimming zones that are defined with less than 10 LEDs).

In one example, the controller 134 may change the pre-defined time period to roll the dimming zones 202, 204, 206, and 208 based on a usage of the display. For example, controller 134 may track and average daily usage time of the display 100. The longer the display 100 is turned on each day, the shorter the pre-defined time period may be. For example, if the display 100 is turned on for 8 hours a day, the controller 134 may roll the dimming zones 202, 204, 206, and 208 every day. If the display 100 is turned on for less than 8 hours a day, the controller 134 may roll the dimming zones 202, 204, 206, and 208 every week, and so forth.

In one example, the pre-defined time period may be dynamically changed over a life of the display 100, as noted above. For example, as LEDs 104 age, the decay rate of the LEDs 104 may increase exponentially. Thus, the controller 134 may roll the dimming zones 202, 204, 206, and 208 every month within a first year of life of the display 100. The controller 134 may then reduce the pre-defined time period to roll the dimming zones 202, 204, 206, and 208 to every week in the second year of life of the display 100. The controller 134 may then reduce the pre-defined time period to roll the dimming zones 202, 204, 206, and 208 to every day in the third year of life of the display 100, and so forth.

In one example, the pre-defined time period may be dynamically changed based on measurements of the light output of the LEDs 104 in each dimming zone 202, 204, 206, and 208 and calculations performed by the controller 134. For example, a sensor may be located in the display that can measure the light output of each LED 104. The light output values for a given voltage may be fed back to the controller 134. The controller 134 may determine that some LEDs 104 are decaying based on the light output values that are measured. The controller 134 may reduce the pre-defined time period based on the calculation that the LEDs 104 are decaying.

For example, the pre-defined time period may be initially set to roll the dimming zones 202, 204, 206, and 208 every month. The pre-defined time period may be left at one month until the controller 134 detects that the LEDs 104 are beginning to decay. Then the controller 134 may change the pre-defined time period to once a week.

FIG. 3 illustrates an example of how the dimming zones 202, 204, 206, and 208 are rolled by the controller 134. In one example, rolling the dimming zones 202, 204, 206, and 208 may be performed by changing an area on the display 100 that is covered by a respective dimming zone 202, 204, 206, and 208. The area may be changed by changing a group of LEDs 104 that define a respective dimming zone 202, 204, 206, and 208.

In one example, the LEDs 104 may be changed by a single LED 104. For example, the areas covered by each dimming zone 202, 204, 206, and 208 may be rolled by shifting the dimming zones 202, 204, 206, and 208 by a single LED 104.

To illustrate, in FIG. 2 the dimming zone 204 may have included LEDs $\mathbf{104}_5$, $\mathbf{104}_6$, $\mathbf{104}_7$, and $\mathbf{104}_8$. However, in FIG. 3 after the dimming zones 202, 204, 206, and 208 are rolled, the dimming zone 204 may now include LEDs $\mathbf{104}_4$, $\mathbf{104}_5$, $\mathbf{104}_6$, and $\mathbf{104}_7$. It should be noted that although the dimming zones 202, 204, 206, and 208 are moved to the left, the dimming zones 202, 204, 206, and 208 may be moved in any direction (e.g., to the right or up and down if the dimming zones are arranged as horizontal rows on the display 100). Although the rolling of the dimming zones 202, 204, 206, and 208 is shown to be performed by shifting by a single LED 104, it should be noted that the rolling of the dimming zones 202, 204, 206, and 208 may be performed by shifting by more than one LED 104.

In other words, the dimming zones 202, 204, 206, and 208 may be rolled by reassigning the LEDs 104 to different dimming zones 202, 204, 206, and 208. For example, the LED $\mathbf{104}_8$ in FIG. 2 may be reassigned from dimming zone 2 to dimming zone 3 in FIG. 3. When an LED 104 is assigned to a different dimming zone 202, 204, 206, or 208, the controller 134 may change the illumination level of the LED 104.

For example, the LED $\mathbf{104}_8$ may emit a first level of light output (e.g. 250 nits) when assigned to dimming zone 2. However, the LED $\mathbf{104}_8$ may emit a second level of light output (e.g., 200 nits) when assigned to dimming zone 3 in FIG. 3.

It should be noted that rolling of the dimming zones 202, 204, 206, and 208 does not include a complete change in the assignment of LEDs 104 to a particular dimming zone 202, 204, 206, and 208. In other words, when a dimming zone 202, 204, 206, or 208 is rolled, the dimming zone maintains at least one common LED 104. For example, in FIG. 3 after the dimming zones 202, 204, 206, and 208 are rolled, the dimming zone 3 may still include LEDs $\mathbf{104}_9$, $\mathbf{104}_{10}$, and $\mathbf{104}_{11}$ that were in zone 3 before the dimming zones 202, 204, 206, and 208 were rolled in FIG. 2.

In addition, when the dimming zones 202, 204, 206, and 208 are rolled, at least one of the dimming zones 202, 204, 206, or 208 may include LEDs 104 that are not adjacent to one another. For example, the dimming zone 1 in FIG. 3 may include LED $\mathbf{104}_{18}$ that is not adjacent to another LED $\mathbf{104}_1$, $\mathbf{104}_2$, or $\mathbf{104}_3$ that is also in the dimming zone 1. Said another way, when the dimming zones 202, 204, 206, and 208 are rolled, at least one of the dimming zones 202, 204, 206, and 208 may include LEDs that are split on opposite sides of the display 100.

In one example, the controller 134 may continue to roll the dimming zones 202, 204, 206, and 208 after expiration of the pre-defined time period for a number of times that is equal to the number of LEDs 104 in each dimming zone 202, 204, 206, and 208. For example, in FIGS. 2 and 3 each dimming zone 202, 204, 206, and 208 may include four LEDs. Thus, if the dimming zones 202, 204, 206, and 208 are rolled by a single LED 104, the dimming zones 202, 204, 206, and 208 may be rolled four time before returning to the original assignment of LEDs 104 for each dimming zone 202, 204, 206, and 208. In other words, after rolling the dimming zones 202, 204, 206, and 208 four times, the dimming zone 2 may include the same LEDS $\mathbf{104}_1$-$\mathbf{104}_4$ that were labeled dimming zone 1 in FIG. 1. The dimming zones 202, 204, 206, and 208 may then be reset to an original position (e.g., dimming zone 1 is reset to include LEDs $\mathbf{104}_1$-$\mathbf{104}_4$, dimming zone 2 is reset to include LEDs $\mathbf{104}_5$-$\mathbf{104}_8$, and so forth) and the rolling of the dimming zones 202, 204, 206, and 208 may be repeated.

Thus, the display 100 may roll the dimming zones 202, 204, 206, and 208. Rolling the dimming zones 202, 204, 206, and 208 may reduce non-uniformity issues associated with HDR displays that have static dimming zones. In addition, rolling the dimming zones 202, 204, 206, and 208 may also blur or reduce the visibly of boundaries that may otherwise be formed by static dimming zones, as discussed above.

Figure 4:
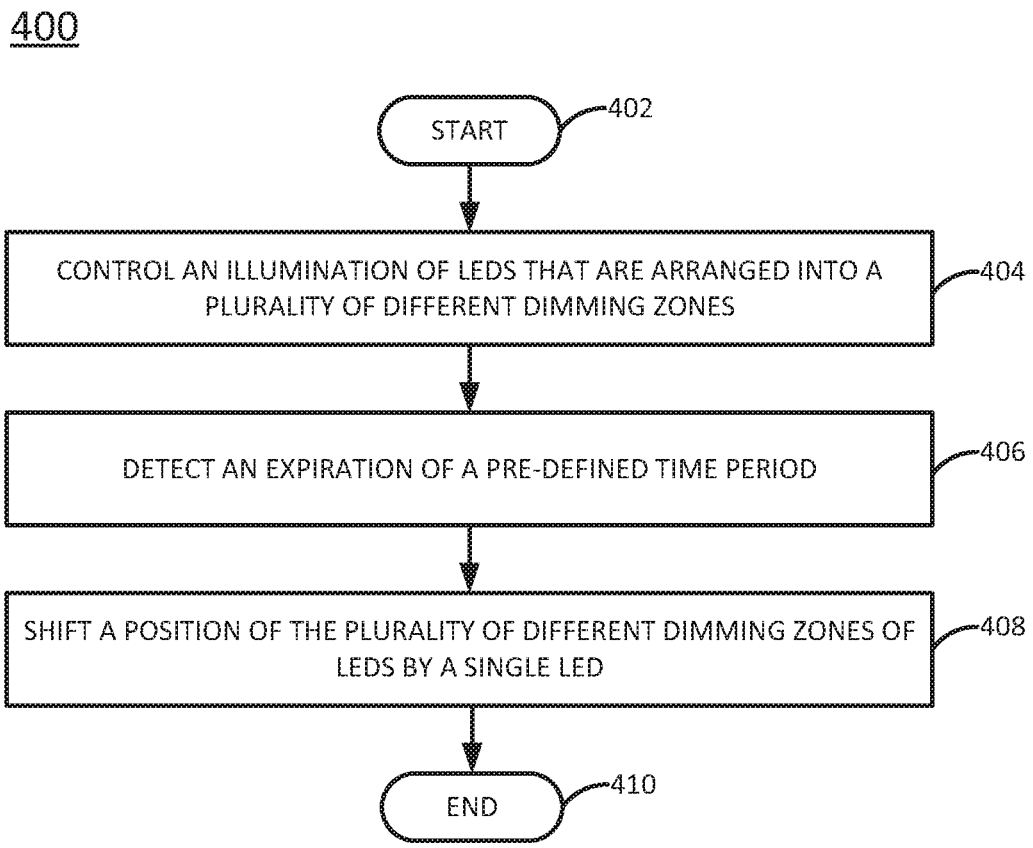
FIG. 4 is a flow chart of an example method for rolling dimming zones of LEDs of a display of the present disclosure.

FIG. 4 illustrates a flow diagram of an example method 400 for rolling dimming zones of LEDs of a display of the present disclosure. In an example, the method 400 may be performed by the display 100, or the apparatus 500 illustrated in FIG. 5, and described below.

At block 402, the method 400 begins. At block 404, the method 400 controls an illumination of light emitting diodes (LEDs) that are arranged into a plurality of different dimming zones of LEDs. The dimming zones may include subsets of LEDs. Each subset of LEDs may have the same number of LEDs or different numbers of LEDs.

At block 406, the method 400 detects an expiration of a pre-defined time period. In one example, the pre-defined time period may be a fixed time period. In one example, the pre-defined time-period may be dynamically changed based on one of a variety of different factors, as discussed above.

At block 408, the method 400 shifts a position of the plurality of different dimming zones of LEDs by a single LED. For example, at least one LED in each subset of LEDs for each dimming zone may be changed. The LED that is reassigned to a new dimming zone may be controlled to operate at a different illumination level than when the LED was in the previously assigned dimming zone.

In one example, at least one of the dimming zones may include non-adjacent LEDs after the dimming zones are shifted or rolled. For example, at least one of the dimming zones may include LEDs that are split on opposite ends of the display (e.g., some LEDs near a left side of the display and other LEDs in the same dimming zone near a right side of the display).

In one example, the method 400 may be repeated for a number of times equal to a number of LEDs in each subset of LEDs for each dimming zone. For example, if each dimming zone has 10 LEDs, then the method 400 may be repeated 10 times. The dimming zones may then be reset to an original position. For example, the LEDs originally assigned to dimming zone 1 may be re-assigned to dimming zone 1, the LEDs originally assigned to dimming zone 2 may be re-assigned to dimming zone 2, and so forth. At block 410, the method 400 ends.

Figure 5:
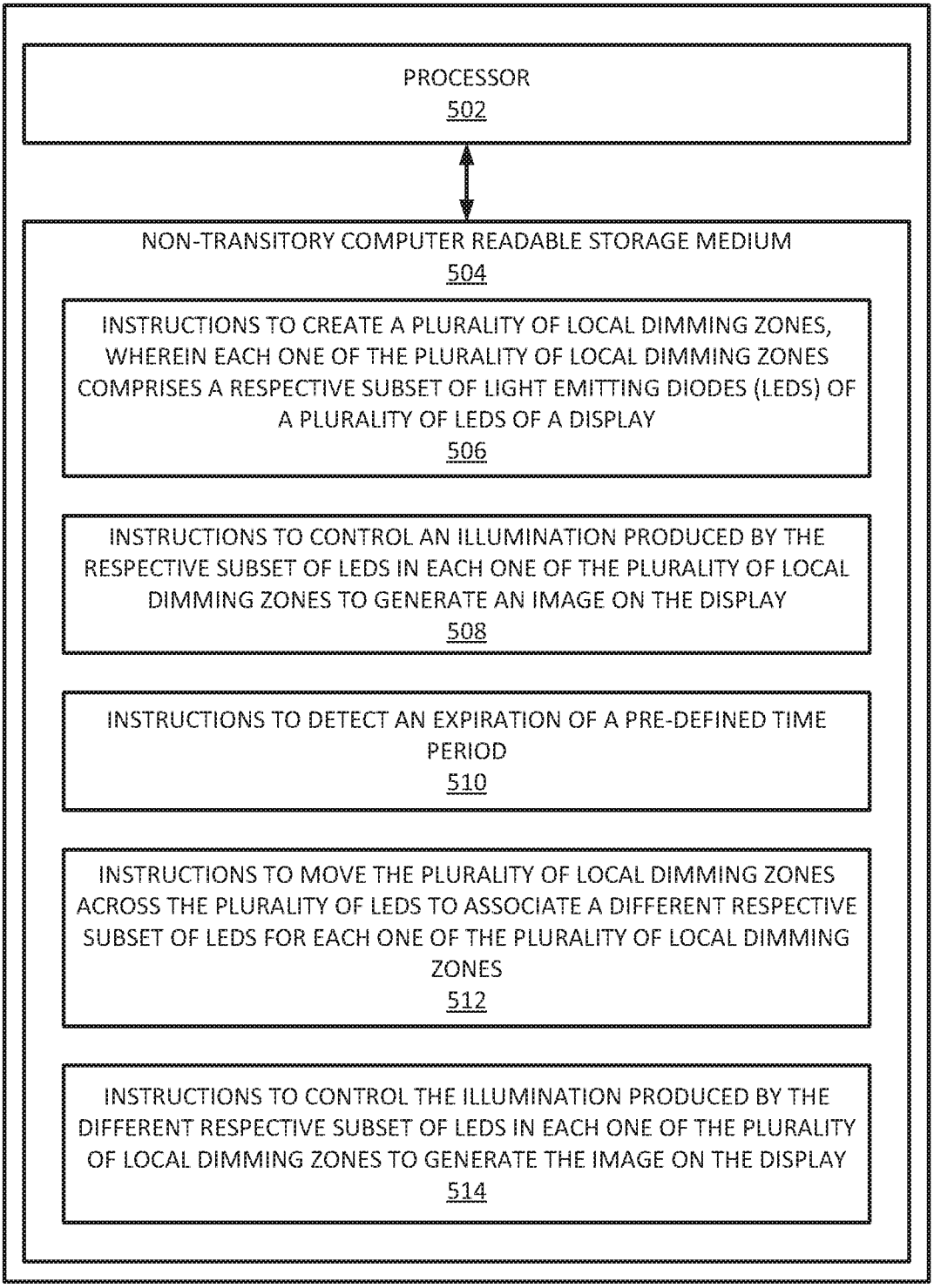
FIG. 5 is a block diagram of an example non-transitory computer readable storage medium storing instructions executed by a processor to roll the dimming zones of LEDs of a display.

FIG. 5 illustrates an example of an apparatus 500. In an example, the apparatus 500 may be the device 102. In an example, the apparatus 500 may include a processor 502 and a non-transitory computer readable storage medium 504. The non-transitory computer readable storage medium 504 may include instructions 506, 508, 510, 512, and 514 that, when executed by the processor 502, cause the processor 502 to perform various functions.

In an example, the instructions 506 may include instructions to create a plurality of local dimming zones, wherein each one of the plurality of local dimming zones comprises a respective subset of light emitting diodes (LEDs) of a plurality of LEDs of a display. The instructions 508 may include instructions to control an illumination produced by the respective subset of LEDs in each one of the plurality of local dimming zones to generate an image on the display. The instructions 510 may include instructions to detect an expiration of a pre-defined time period. The instructions 512 may include instructions to move the plurality of local dimming zones across the plurality of LEDs to associate a different respective subset of LEDs for each one of the plurality of local dimming zones. The instructions 514 may include instructions to control the illumination produced by the different respective subset of LEDs in each one of the plurality of local dimming zones to generate the image on the display.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

The invention claimed is:

1. A display, comprising:

a plurality of light emitting diodes (LEDs);

a thin film transistor (TFT) substrate formed over the LEDs to control emission of light from the plurality of LEDs;

a liquid crystal layer formed over the TFT substrate;

a color filter (CF) substrate formed over the liquid crystal layer to control a color of the light emitted from the plurality of LEDs; and a controller communicatively coupled to the plurality of LEDs to group subsets of LEDs of the plurality of LEDs into a plurality of different local dimming zones, wherein the subsets of LEDs in each one of the plurality of different local dimming zones changes over time, wherein the subsets of LEDs are changed after an expiration of a pre-defined time period is detected, wherein the subsets of LEDs are changed by shifting a position of the plurality of different local dimming zones by a single LED after the expiration of the pre-defined time period is detected.

2. The display of claim 1, wherein the TFT substrate comprises:

a glass substrate;

a polarizer on a bottom side of the glass substrate;

a common electrode on a top side of the glass substrate;

an insulator on the common electrode;

a pixel electrode on the insulator; and an alignment layer on the pixel electrode.

3. The display of claim 1, wherein the CF substrate comprises:

a glass substrate with color filters;

a polarizer on a top side of the glass substrate;

a common electrode on a bottom side of the glass substrate; and an alignment layer on the bottom side of the common electrode.

4. The display of claim 1, wherein the subsets of LEDs contain a same number of LEDs for each one of the plurality of different local dimming zones.

5. The display of claim 1, wherein at least one dimming zone of the plurality of different local dimming zones contains non-adjacent LEDs of the plurality of LEDs.

6. A method comprising:

controlling, by a processor, an illumination of light emitting diodes (LEDs) that are arranged into a plurality of different dimming zones of LEDs;

detecting, by the processor, an expiration of a pre-defined time period; and shifting, by the processor, a position of the plurality of different dimming zones of LEDs by a single LED.

7. The method of claim 6, further comprising:

repeating, by the processor, the detecting and the shifting for a number of times equal to a number of LEDs in the plurality of different dimming zones of LEDs; and resetting, by the processor, the plurality of different dimming zones of LEDs to an original position.

8. The method of claim 6, wherein the pre-defined time period is a function of a number of LEDs in each one of the plurality of different dimming zones of LEDs.

9. The method of claim 6, wherein the illumination of an LED changes when the LED is assigned to a different one of the plurality of different dimming zones of LEDs.

10. The method of claim 6, wherein the shifting comprises:

changing, by the processor, an assignment of at least one LED in each one of the plurality of different dimming zones of LEDs.

11. A non-transitory computer readable storage medium encoded with instructions executable by a processor, the non-transitory computer-readable storage medium comprising:

instructions to create a plurality of local dimming zones, wherein each one of the plurality of local dimming zones comprises a respective subset of light emitting diodes (LEDs) of a plurality of LEDs of a display;

instructions to control an illumination produced by the respective subset of LEDs in each one of the plurality of local dimming zones to generate an image on the display;

instructions to detect an expiration of a pre-defined time period;

instructions to move the plurality of local dimming zones across the plurality of LEDs to associate a different respective subset of LEDs for each one of the plurality of local dimming zones; and instructions to control the illumination produced by the different respective subset of LEDs in each one of the plurality of local dimming zones to generate the image on the display.

12. The non-transitory computer readable storage medium of claim 11, wherein at least one zone is split across LEDs that are located on opposite sides of the display.

13. The non-transitory computer readable storage medium of claim 11, wherein the different respective subset of LEDs contains at least one common LED with the respective subset of LEDs.

* * * * *